United States Patent [19]

Nguyen

[11] Patent Number: 4,967,177

[45] Date of Patent: Oct. 30, 1990

[54] AUDIOVISUAL SIGNALING DEVICE AND METHOD

[75] Inventor: Luy B. Nguyen, Wayside, N.J.

[73] Assignee: Wheelock, Inc., Long Branch, N.J.

[21] Appl. No.: 405,740

[22] Filed: Sep. 11, 1989

[51] Int. Cl.[5] ..... G08B 27/00

[52] U.S. Cl. ..... 340/326; 340/331; 340/332; 340/384 R; 340/815.11; 315/200 A; 315/241 S

[58] Field of Search ..... 340/326, 331, 332, 334 R, 340/334 E, 816.11; 315/200 A, 219, 241 S, 241 P, 241 R, 307, 127; 363/15, 19, 90, 91, 50, 78, 124, 131; 307/25

[56] References Cited

U.S. PATENT DOCUMENTS

| | | | |
|---|---|---|---|
| 3,921,034 | 11/1975 | Nakamura | 315/241 |
| 4,065,700 | 12/1977 | Liebman | 315/241 |
| 4,101,880 | 7/1978 | Haus | 340/326 |
| 4,274,084 | 6/1981 | Hans | 340/326 |
| 4,486,691 | 4/1984 | Beggs | 315/241 |
| 4,495,447 | 1/1985 | Shigemi | 315/241 |
| 4,742,328 | 5/1988 | Arai et al. | 340/326 |
| 4,775,821 | 10/1988 | Sikora | 315/219 |
| 4,779,027 | 10/1988 | Sikora | 315/127 |

*Primary Examiner*—Donnie L. Crosland
*Attorney, Agent, or Firm*—Brumbaugh, Graves, Donohue & Raymond

[57] ABSTRACT

An audiovisual signaling device includes in electrical connection: (a) an auditory output portion which produces an auditory output and a corresponding low voltage oscillatory signal; (b) a converter portion which is responsive to and converts the low voltage oscillatory signal to a repetitively produced corresponding high voltage intermittent spike signal; (c) a visual output portion which produces a visual output; and (d) a portion responsive to the high voltage intermittent spike signal to repetitively activate the visual output.

24 Claims, 2 Drawing Sheets

AUDIOVISUAL SIGNALING DEVICE AND METHOD

BACKGROUND OF THE INVENTION

This invention relates to an audiovisual signaling device and to a method of producing an audiovisual signal. More particularly, the audiovisual signaling device of this invention comprises an auditory output portion which produces an auditory output and a corresponding low voltage oscillatory signal, a converter portion which is responsive to and converts the low voltage oscillatory signal to a repetitively produced corresponding high voltage intermittent spike signal, a visual output portion, and a portion responsive to the high voltage intermittent spike signal to repetitively activate the visual output. The method of this invention comprises producing an auditory output and a corresponding low voltage oscillatory signal, converting the low voltage oscillatory signal to a corresponding high voltage intermittent spike signal, and producing a visual output responsive and corresponding to the high voltage intermittent spike signal.

Audiovisual signaling devices may be employed in a variety of applications, particularly those applications dealing with public safety. For example, warning or alarm systems such as fire alarm systems are ideally suited to include both auditory and visual signals to maximize the probability that they will attract attention in an emergency. Such systems typically employ means for producing an audio output such as a horn in electrical connection to means for producing a visual output such as a flash tube or strobe, as exemplified by co-assigned U.S. Pat. No. 4,101,880 (Haus), which employs electromechanical means for circuit interruption and flash tube circuitry charging. Timing circuits used to control the flash rate of visual signaling devices often employ switches to achieve proper flashing of a flash tube or strobe, as exemplified by U.S. Pat. No. 4,486,691 (Beggs).

However, as warning and alarm systems are often exposed to severe use, such as shock and vibration, it is advantageous for the circuitry and operating components associated with the system to be as simple and durable as possible. It would therefore be advantageous to avoid the use of electromechanical means, which are subject to wear and malfunction, to achieve switching, circuit interruption and flashing of the visual signal. It is one object of this invention to provide an audiovisual signaling device and method which advantageously avoids the use of electromechanical means of converting low to high voltage DC current, switching, and tube flashing to produce a visual signal.

The use of DC to DC converter circuitry to energize strobe and flash lamps is well known, as exemplified by U.S. Pat. Nos. 3,921,034 (Nakamura), 4,495,447 (Shigemi), 4,775,821 (Sikora), and 4,779,027 (Sikora). However, the use of DC to DC converter means typically requires the use of complex and costly circuitry. It would thus be advantageous, in terms of both circuit complexity and associated component cost, to employ less complex means of converting low to high voltage DC current in an audiovisual signaling device. It is another object of this invention to generate a visual signal by converting a low voltage signal to a high voltage spike signal by advantageously employing converter means which are less cumbersome and require less components than conventional DC to DC converter means.

An audiovisual signaling device may employ an oscillatory signal to generate the audio and visual portions of the device. For example, U.S. Pat. No. 4,065,700 (Liebman) discloses a DC-powered strobe light circuit which employs oscillating means which are connected to the DC source and integral to the circuit. However, it would be advantageous to employ means for generating the oscillatory signal which are external to the circuitry associated with means for generating the visual signal, due to the greater power requirements and component costs of having the oscillatory signal generating means within the circuitry used to generate the visual signal. It is another object of this invention to employ an oscillatory signal for use in generating an audiovisual signal wherein the oscillatory signal is generated external to the portion of the device used for generating the visual signal.

SUMMARY OF THE INVENTION

This invention is directed to an audiovisual signaling device and to a method of producing an audiovisual signal. The audiovisual signaling device of this invention comprises in electrical connection:

(a) an auditory output portion which produces an auditory output and a corresponding low voltage oscillatory signal;

(b) a converter portion which is responsive to and converts the low voltage oscillatory signal to a repetitively produced corresponding high voltage intermittent spike signal;

(c) a visual output portion which produces a visual output; and (d) a portion responsive to the high voltage intermittent spike signal to repetitively activate the visual output.

In a preferred embodiment, the audiovisual signaling device additionally comprises a timing circuit to control the flash rate of the visual output.

The method of this invention comprises:

(a) producing an auditory output and a corresponding low voltage oscillatory signal;

(b) converting the low voltage oscillatory signal to a high voltage intermittent spike signal; and (c) producing a visual output responsive to the high voltage intermittence spike signal.

In a preferred embodiment, the method of this invention additionally employs a timing circuit to control the flash rate of the visual output.

DETAILED DESCRIPTION OF THE INVENTION

A better understanding of the invention may be gained from a consideration of the following detailed description of the preferred embodiments thereof viewed in conjunction with the appended figures.

Figure 1:
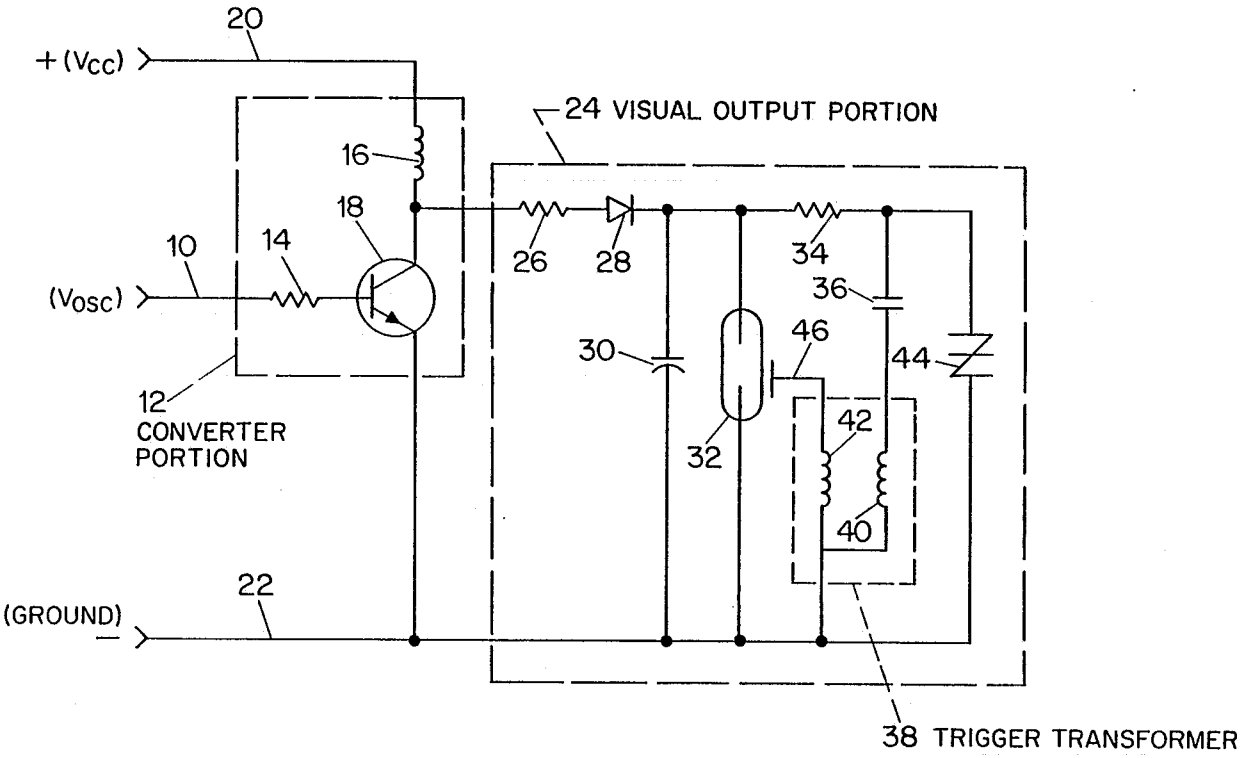
FIG. 1 is a schematic diagram of a preferred embodiment of the device of this invention.

FIG. 1 depicts a schematic diagram of one preferred embodiment of the audiovisual signaling device of this invention. In FIG. 1, an electronic horn (not shown) produces an auditory output and correspondingly produces a low voltage oscillatory signal Vosc having a voltage in the range of 1–16 volts RMS, typically 3–6 volts RMS, and a frequency in the range of 200–5000 Hz, preferably 1000–4000 Hz. The low voltage oscillatory signal Vosc is introduced through lead 10 to converter portion 12 which is responsive to the low voltage oscillatory signal Vosc and repetitively produces a corresponding high voltage intermittent spike signal. Converter portion 12 comprises resistor 14 having a resistance value $R_1$ in the range of 0Ω–50K, inductor or "choke" 16 having an inductance $L_1$ in the range of 100μH–5H, and transistor 18 characterized by parameter $Q_1$. Voltage Vcc having a range of 4–60 volts DC, typically 6, 12, 24 or 48 volts DC, is provided by positive (Vcc) and negative (ground) leads 20 and 22, respectively.

The high voltage intermittent spike signal produced by converter portion 12, having a voltage in the range of 100–500 volts peak, typically about 250 volts peak and a frequency corresponding to that of the above-described low voltage signal is provided to visual output portion 24, which is electrically connected to converter portion 12. Visual output portion 24 comprises resistor 26, diode 28, capacitor 30 having a capacitance $C_1$, lamp 32 which is typically a xenon flash tube, resistor 34, trigger capacitor 36, and trigger transformer 38 which comprises primary coil 40, secondary coil 42, semiconductor means 44, and electrode 46. Trigger transformer 38 produces a voltage in the range of 6000–12000 volts peak to peak, typically about 8000 volts peak to peak when energized. The charge voltage to visual output means 24 is controlled by semiconductor means 44, which is electrically connected to trigger capacitor 36 and trigger transformer 38. In this embodiment, semiconductor means 44 is a sidac which includes a resistive region of operation and a negative resistance of operation beginning at a breakdown voltage. At the breakdown voltage, typically about 250 volts DC, the sidac commences to conduct current, with the breakdown voltage selected to be the maximum permissible voltage for the above-described circuitry associated with visual output portion 24. Visual output portion 24 causes lamp 32 to flash with a frequency at or below about 3 Hz. $R_1$, $Q_1$, $L_1$, and $C_1$, are variable and dependent upon the value of Vcc, the input low voltage oscillatory frequency, and the light intensity of lamp 32.

The method of operation of a preferred embodiment of this invention as depicted in FIG. 1 may be described as follows. An input voltage Vcc is applied across leads 20 and 22, and an auditory output and corresponding low voltage oscillatory signal Vosc produced by an electronic horn (not shown) is introduced through lead 10 to converter portion 12, which comprises resistor 14, "choke" 16 and transistor 18. Converter portion 12 is responsive to the input low voltage oscillatory signal Vosc and produces a corresponding high voltage intermittent spike signal, which is provided to visual output portion 24. When lamp 32 is nonconducting, thus forming an open switch, the high voltage spike signal charges capacitor 30 and trigger capacitor 36, which are in parallel to one another.

Trigger capacitor 36 is operatively associated with sidac 44 and trigger transformer 38. When the voltage across charged trigger capacitor 36 equals the breakdown voltage of sidac 44, trigger capacitor 36 discharges through sidac 44, thereby activating trigger transformer 38 and primary coil 40 and secondary coil 42 contained therein. Secondary coil 42 is inductively coupled to primary coil 40 and operatively associated with lamp 32 by means of electrode 46 which is closely positioned to lamp 32. Trigger transformer 38 energizes lamp 32, thereby causing a drop in the resistance of lamp 32 and forming a closed switch thus causing capacitor 30 to discharge through and cause illumination of lamp 32. The intensity of the resulting light burst from lamp 32 depends on the amount of charge accumulated in capacitor 30 prior to discharge. Resistor 34 provides a degree of isolation between capacitor 30 and trigger capacitor 36 to prevent trigger capacitor 36 from discharging through lamp 32. Resistor 26 acts both to limit backcurrent flow to the low voltage portion of the circuit, i.e. converter means 12, and to reduce holding current in lamp 32 subsequent to discharge, thereby reducing afterglow phenomenon in the device. Diode 28 is provided to isolate visual output portion 24 from converter portion 12 and for holding a charge on capacitor 30 and trigger capacitor 36 prior to discharge thereof through lamp 32 and sidac 44, respectively.

The following Table 1 shows representative types and values of the elements described above in connection with a particularly preferred embodiment of FIG. 1:

TABLE 1

| Element | Description |
|---|---|
| Vcc | 24 volts DC |
| Resistor 14 | 2.2KΩ |
| Inductor 16 | 45mH |
| Transistor 18 | 2N6516 or MOSFET IRF711 |
| Resistor 26 | 100 Ω |
| Diode 28 | 1N4004 |
| Capacitor 30 | 250 v; 15 μf |
| Lamp 32 | Zenon Flashtube |
| Resistor 34 | 220 K |
| Capacitor 36 | 400 v; .047 μf |
| Trigger Transformer 38 | Turn Ratio 1:49 |
| Sidac 44 | 250 v (breakdown voltage) |
| Horn (not shown) | Wheelock 24 volt DC Electronic Horn Model No. EHS-24 |

Figure 2:
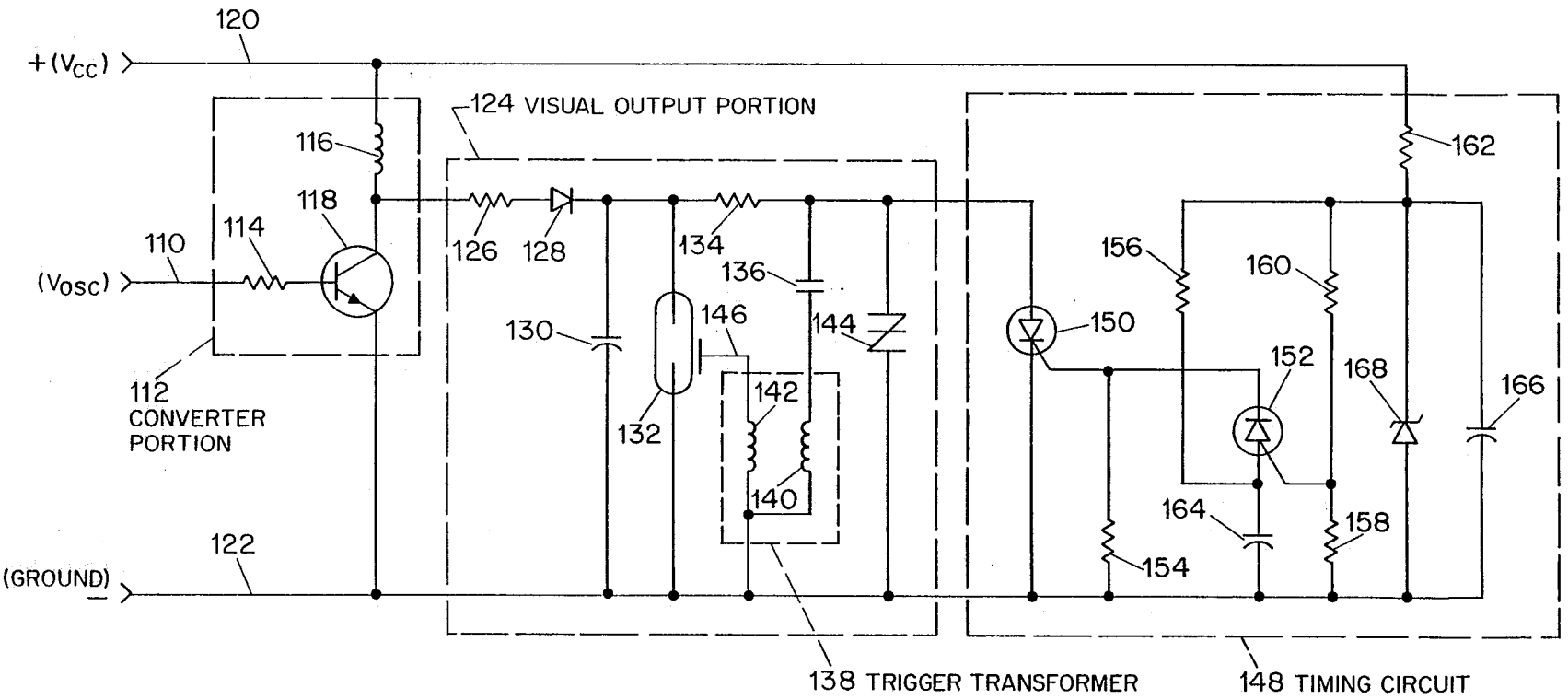
FIG. 2 is a schematic diagram of an alternate preferred embodiment of the device of this invention.

FIG. 2 depicts a schematic diagram of an alternate preferred embodiment of the audiovisual signaling device of this invention. In FIG. 2, an electronic horn (not shown) correspondingly produces a low voltage oscillatory signal Vosc having a voltage in the range of 1–16 volts RMS, typically 3–6 volts RMS, and a frequency in the range of 200–5000 Hz, preferably 1000–4000 Hz. The low voltage oscillatory signal Vosc is introduced by lead 110 to converter portion 112 which is responsive to the low voltage oscillatory signal Vosc and respectively produces a corresponding high voltage intermittent spike signal. Converter portion 112 comprises resistor 114 having a resistance value $R_2$ in the range of 0Ω–50K, inductor or "choke" 116 having an inductance $L_2$ in the range of 100μH–5H, and transistor 118 characterized by parameter $Q_2$. Means for applying a voltage Vcc, typically 6, 12, 24 or 48 volts DC, are provided by positive (Vcc) and negative (ground) leads 120 and 122, respectively.

The high voltage intermittent spike signal produced by converter portion 112, having a voltage in the range of 100–500 volts peak, typically about 250 volts peak and a frequency corresponding to that of the above-described low voltage signal is provided to visual output portion 124, which is electrically connected to converter portion 112. Visual output portion 124 comprises resistor 126, diode 128, capacitor 130 having capacitance $C_2$, lamp 132 which is typically a xenon tube, resistor 134, trigger capacitor 136, and trigger transformer 138 which comprises primary coil 140 secondary coil 142, electrode 146, and semiconductor means 144. Trigger transformer 138 produces a voltage in the range of 6000–12,000 volts peak to peak, typically about 8000 volts peak to peak, when energized. In this embodiment, semiconductor portion 144 is a sidac having a breakdown voltage of about 250 volts DC. $R_2$, $Q_2$, $L_2$ and $C_2$ are variable and dependent upon the value of Vcc, the input low voltage oscillatory frequency, and the light intensity of lamp 132. Visual output portion 124 causes lamp 132 to flash with a frequency at or below about 3 Hz.

In the embodiment of this invention depicted by FIG. 2, the flash rate of lamp 132 is controlled by timing circuit 146 as long as input voltage Vcc is applied. If input voltage Vcc is interrupted, lamp 132 will flash in accordance with the interruptions. Timing circuit 148, which is electrically connected to visual output portion 124, comprises silicon control rectifier (SCR) 150, programmable unijunction transistor (PUT) 152, resistors 154, 156, 158, 160, and 162, capacitors 164 and 166, and zener diode 168, all electrically connected as shown in FIG. 2.

The method of operation of a preferred embodiment of this invention as depicted in FIG. 2 may be described as follows. An input voltage Vcc is applied across leads 120 and 122, and a low voltage oscillatory signal Vosc produced by an auditory output (not shown) is introduced by lead 110 to converter portion 112, which comprises resistor 114, "choke" 116 and transistor 118. Converter portion 112 is responsive to the input low voltage oscillatory signal Vosc and produces a corresponding high voltage intermittent spike signal, which is provided to visual output portion 124. When lamp 132 is nonconducting, thus forming an open switch, the high voltage spike signal charges capacitor 130 and trigger capacitor 136, which are in parallel to one another.

Trigger capacitor 136 is operatively associated with sidac 144, trigger transformer 138, and timing circuit 148. In trigger transformer 138, secondary coil 142 is inductively coupled to primary coil 140 and operatively associated with lamp 132 by means of electrode 146 which is closely positioned to lamp 132. When activated by receiving a discharge from trigger capacitor 136, trigger transformer 138 energizes lamp 132, thereby causing a drop in the resistance of lamp 132 and forming a closed switch thus causing capacitor 130 to discharge through and cause illumination of lamp 132. The intensity of the resulting light burst from lamp 132 depends upon the amount of charge accumulated in lamp 132 prior to discharge. Resistor 134 provides a degree of isolation between capacitor 130 and trigger capacitor 136 to prevent trigger capacitor 136 from discharging through lamp 132. Resistor 126 acts both to limit back-current flow to the low voltage portion of the circuit, i.e. converter portion 112, and to reduce holding current in lamp 132 subsequent to discharge, thereby reducing afterglow phenomenon in the device. Diode 128 is provided to isolate visual output portion 124 from converter portion 112, and for holding a charge on capacitor 130 and trigger capacitor 136 prior to discharge.

Timing circuit 148 controls the flash rate of lamp 132 as long as input voltage Vcc is applied across leads 120 and 122. The operation of timing circuit 148 in conjunction with visual output portion 124 may be described as follows. Input voltage Vcc is applied across leads 120 and 122, and thereby across resistor 162 to zener diode 168, thus stepping down the initial voltage. Capacitor 166, which is in parallel to zener diode 168, acts to dampen any transient effects or noise from supplied voltage Vcc and regulates the voltage across zener diode 168. Stepped down voltage from zener diode 168 is applied to charge capacitor 164, and also is applied to a voltage divider comprising resistors 158 and 160, which thereby provides a reference voltage to the gate of PUT 152. The series combination of resistor 156 and capacitor 164 are in parallel to the voltage divider. When the voltage at charged capacitor 164 exceeds the reference voltage at the gate of PUT 152, PUT 152 will energize and trigger SCR 150, with resistor 154 enabling capacitor 164 to discharge. Energized SCR 150 acts as a short and in turn causes visual output portion 124 to activate as previously described, resulting in the flashing of lamp 132 by bypassing of sidac 144 and activation of trigger transformer 138. However, sidac 144 continues to control the charge voltage to visual output portion 124 by means of the breakdown voltage of sidac 144, typically about 250 volts DC.

The above-described cycle with respect to timing circuit 148 is repeated to produce intermittent flashing of lamp 132. The precise timing sequence of timing circuit 148 is a function of the individual components selected, as is well-known to those skilled in the art. If for any reason input voltage Vcc is interrupted, the flashing of lamp 132 will follow the interruptions.

The following Table 2 shows representative types and values of the elements described above in connection with a particularly preferred embodiment of FIG. 2:

TABLE 2

| Element | Description |
|---|---|
| Vcc | 24 volts DC |
| Resistor 114 | 2.2KΩ |
| Inductor 116 | 45mH |
| Transistor 118 | 2N6516 or MOSFET IRF711 |
| Resistor 126 | 100Ω |
| Diode 128 | 1N4004 |
| Capacitor 130 | 250 V; 15 μf |
| Lamp 132 | Zenon flashtube |
| Resistor 134 | 220 K |
| Capacitor 136 | 400 V; .047 μf |
| Trigger Transformer 138 | Turn Ratio 1:49 |
| Sidac 144 | 250 V (breakdown voltage) |
| PUT 150 | C203D |
| SCR 152 | 2N6027 |
| Resistor 154 | 47 Ω |
| Resistor 156 | 220 K |
| Resistor 158 | 12 K |
| Resistor 160 | 33 K |
| Resistor 162 | 4.7 K |
| Capacitor 164 | 2.2 μf |
| Capacitor 166 | 50 V, 10 μf |
| Zener diode 168 | 1N 4742 |
| Horn (not shown) | Wheelock 24 volt DC Electronic Horn Model No. EHS-24 |

In one preferred embodiment of this invention, a WHEELOCK model No. EHS-24 volt DC electronic horn is employed to produce the above-described auditory output and corresponding oscillatory signal. In another preferred embodiment of this invention, a WHEELOCK model No. EHS-12 12 volt DC electronic horn or the "Miz series" strobe horn is employed to generate the auditory output and corresponding low voltage oscillatory signal.

Figure 3:
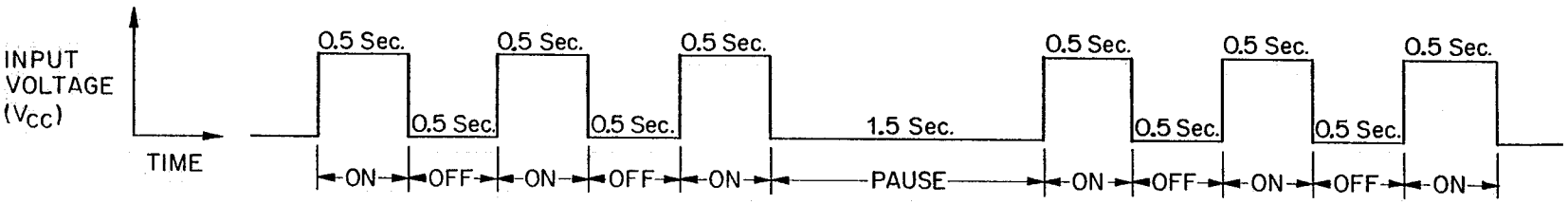
FIG. 3 graphically depicts a code three temporal pattern signal which may be employed as the input voltage (VCC) signal in an alternate preferred embodiment of this invention.

In another preferred embodiment of this invention, the input voltage Vcc is a defined temporal pattern. For example, in one particularly preferred embodiment, the input signal is a "code 3" temporal pattern as described by the National Fire Protection Association (NFPA) as the standard recommended pattern for all fire signals. As depicted in FIG. 3, the code 3 temporal pattern may basically be described as a square wave characterized in that it has three 0.5 second "on" voltage portions interspersed by two 0.5 second "off" portions, followed by a 1.5 second pause after which the cycle is repeated. If the code 3 temporal pattern is employed as an input signal to produce an auditory output, the code 3 temporal pattern also becomes the corresponding low voltage oscillatory signal produced.

In one particularly preferred embodiment of this invention, the input of a code 3 temporal pattern signal to the above-described WHEELOCK model No. EHS-24 electronic horn will provide a corresponding low voltage oscillatory signal suitable for uses in this invention.

Although this invention has been illustrated by reference to specific embodiments, it will be apparent to those skilled in the art that various changes and modifications may be made which closely fall within the scope of this invention.

I claim:

1. An audiovisual signaling device comprising in electrical connection:
   (a) means for producing an auditory input and a corresponding low voltage oscillatory signal;
   (b) converter means in electrical connection to the means for producing said auditory output and corresponding low voltage oscillatory signal, said converter means responsive to the low voltage oscillatory signal to repetitively produce a corresponding high voltage output intermittent spike signal;
   (c) means for producing a visual output in electrical connection to said converter means; and
   (d) means responsive to the high voltage intermittent spike signal and in electrical connection to said converter means to repetitively activate the visual output means.

2. An audiovisual signaling device according to claim 1, in which the low voltage oscillatory signal has a voltage in the range of about 1–16 volts RMS and a frequency in the range of about 200–5000 Hz.

3. An audiovisual signaling device according to claim 2, in which the low voltage oscillatory signal has a voltage in the range of about 3–6 volts RMS, and a frequency in the range of about 1000–4000 Hz.

4. An audiovisual signaling device according to claim 1, in which the means for producing an auditory output and corresponding low voltage oscillatory signal is an electronic horn using a defined temporal pattern to produce a corresponding temporal pattern, auditory output and low voltage oscillatory signal.

5. An audiovisual signaling device according to claim 4, in which the defined temporal pattern is characterized as a square-wave in which the peaks of the square-wave produce the low voltage temporal pattern oscillatory signal.

6. An audiovisual signaling device according to claim 1, in which the converter means responsive to the low voltage oscillatory signal comprises a resistor, an inductor, and a transistor in electrical connection.

7. An audiovisual signaling device according to claim 1, in which the high voltage intermittent spike signal has a voltage in the range of about 100–500 volts peak.

8. An audiovisual signaling device according to claim 7, in which the high voltage intermittent spike signal has a voltage of about 250 volts peak.

9. An audiovisual signaling device according to claim 1, in which the means for producing a visual output comprise a lamp or flash tube and means for illuminating the lamp or flash tube in response to the high voltage intermittent spike signal.

10. An audiovisual signaling device according to claim 1, additionally comprising a timing circuit electrically connected to the means for producing a visual output to control the flash rate of the visual output.

11. An audiovisual signaling device according to claim 1, in which the visual output produced is at a frequency at or below about 3 Hz.

12. An audiovisual signaling device comprising in electrical connection:
   (a) means for producing an auditory output and a corresponding low voltage oscillatory signal;
   (b) converter means in electrical connection to the means for producing said auditory output and corresponding low voltage oscillatory signal, said converter means responsive to the low voltage oscillatory signal to repetitively produce a corresponding high voltage output intermittent spike signal;
   (c) means for producing a visual output in electrical connection to said converter means;
   (d) means responsive to the high voltage intermittent spike signal and in electrical connection to said converter means to repetitively activate the visual output; and
   (e) a timing circuit electrically connected to the means for producing a visual output, said visual output means having a flash rate controlled by said timing circuit.

13. A method of producing an audiovisual signal comprising the steps of:
   (a) producing an auditory output and a corresponding low voltage oscillatory signal;
   (b) converting the low voltage oscillatory signal to a corresponding high voltage intermittent spike signal; and
   (c) producing a visual output responsive and corresponding to the high voltage intermittent spike signal.

14. A method according to claim 13, in which the low voltage oscillatory signal has a voltage in the range of about 1–16 volts RMS and a frequency in the range of about 200–5000 Hz.

15. A method according to claim 14, in which the low voltage oscillatory signal has a voltage in the range of about 3–6 volts RMS, and a frequency in the range of about 1000–4000 Hz.

16. A method according to claim 13, in which the auditory output is produced by an electronic horn using a defined temporal pattern to produce a corresponding temporal pattern auditory output and low voltage oscillatory signal.

17. A method according to claim 16, in which the defined temporal pattern is characterized as a square-wave in which the peaks of the square-wave produce the low voltage temporal pattern oscillatory signal.

18. A method according to claim 13, in which the the low voltage oscillatory signal is converted to a high voltage spike signal by means of a resistor, an inductor, and a transistor in electrical connection.

19. A method according to claim 13, in which the high voltage intermittent spike signal has a voltage in the range of about 100–500 volts peak.

20. A method according to claim 19, in which the high voltage intermittent spike signal has a voltage of about 250 volts peak.

21. A method according to claim 13, in which the visual output is produced by means of a lamp or flash tube and means for illuminating the lamp or flash tube in response to the high voltage intermittent spike signal.

22. A method according to claim 13, which additionally employs a timing circuit electrically connected to the visual output to control the flash rate of the visual output.

23. A method according to claim 13, in which the visual output produced is at a frequency at or below about 13 Hz.

24. A method of producing an audiovisual signal comprising the steps of:

(a) producing an auditory output and a corresponding low voltage oscillatory signal;

(b) converting the low voltage oscillatory signal to a corresponding high voltage intermittent spike signal;

(c) producing a visual output responsive and corresponding to the high voltage intermittent spike signal; and (d) employing a timing circuit electrically connected to the visual output to control the flash rate of the visual output.

* * * * *

UNITED STATES PATENT AND TRADEMARK OFFICE

CERTIFICATE OF CORRECTION

PATENT NO. : 4,967,177

DATED : Oct. 30, 1990

INVENTOR(S) : Nguyen

It is certified that error appears in the above-identified patent and that said Letters Patent is hereby corrected as shown below:

ON TITLE PAGE: first line of ABSTRACT, "includes" should read --comprises--.

Col. 7, line 33, "input" should read --output--.

Signed and Sealed this

Twelfth Day of May, 1992

*Attest:*

DOUGLAS B. COMER

*Attesting Officer*

*Acting Commissioner of Patents and Trademarks*